United States Patent [19]

McPeak et al.

[11] 4,117,557

[45] Oct. 3, 1978

[54] HORIZONTALLY ADJUSTABLE CURTAIN RODS FOR BATHROOM STALLS

[76] Inventors: Walter G. McPeak, 3505 Kilkenny, West, Tallahassee, Fla. 32303; James K. Myhand, P.O. Box 37, Pine Mountain, Ga. 31822

[21] Appl. No.: 810,382

[22] Filed: Jun. 27, 1977

[51] Int. Cl.[2] ..... A47K 3/14; A47H 1/022

[52] U.S. Cl. ..... 4/149; 4/154; 160/330; 160/349 R

[58] Field of Search ..... 4/145, 146, 148, 149, 4/151–155; 160/349 R, 330; 211/105.2, 105.4–105.6; 248/298, 408, 409, 412

[56] References Cited

U.S. PATENT DOCUMENTS

| | | | |
|---|---|---|---|
| 2,481,397 | 9/1949 | Dalton, Jr. | 4/149 |
| 2,504,561 | 4/1950 | McMillan | 4/149 |
| 2,545,648 | 3/1951 | Byrne | 4/149 |
| 2,573,985 | 11/1951 | Porter | 4/149 |
| 2,594,049 | 4/1952 | Matos | 4/149 |
| 2,778,030 | 1/1957 | Goche | 4/149 |
| 3,137,512 | 6/1964 | Carpezzi | 248/408 UX |
| 3,356,329 | 12/1967 | Santo | 248/298 X |
| 3,418,665 | 12/1968 | Long | 4/149 |

FOREIGN PATENT DOCUMENTS

| | | | |
|---|---|---|---|
| 320,877 | 8/1902 | France | 248/408 |
| 511,480 | 10/1930 | Fed. Rep. of Germany | 248/412 |

*Primary Examiner*—Stuart S. Levy
*Attorney, Agent, or Firm*—Robert Brown, Jr.

[57] ABSTRACT

A bathroom stall having a doorway and a catch basin or bath tub with a wall thereof lying substantially in the plane of the doorway, in combination with a U-shaped cantilevered rod for suspending the intermediate portion of the curtain over the doorway while the laterally disposed end portions of the curtain project inwardly of the stall in parallel adjacent positons relative to the opposed doorway jambs, respectively. The legs of the U-shaped rod are telescopically mounted and horizontally adjustable in sleeved wall brackets to thereby permit the suspended curtain to assume successive parallel positions as it is moved back and forth through the doorway. Thus, the curtain may be positioned within the stall during a bath to prevent escape of water, and at other times positioned outside for drying and full display.

3 Claims, 8 Drawing Figures

FIG. 1
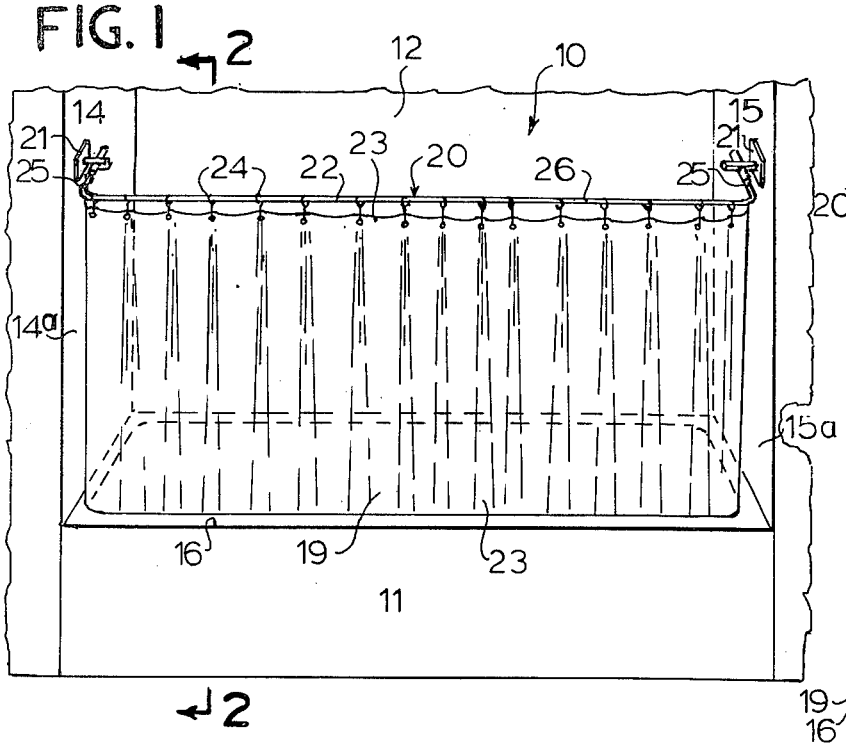
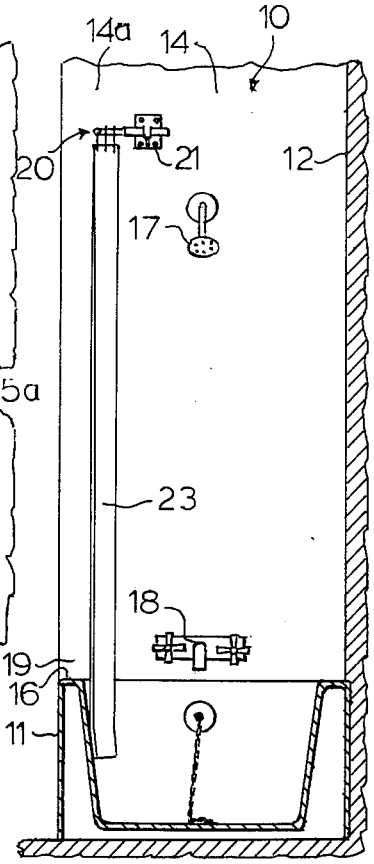
FIG. 2
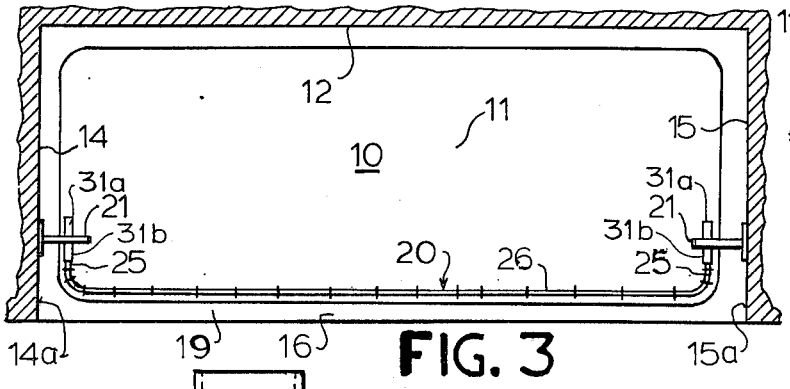
FIG. 3
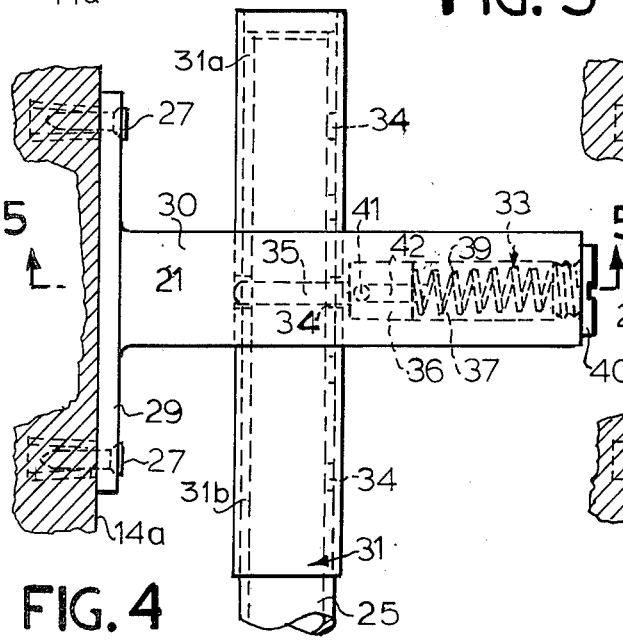
FIG. 4
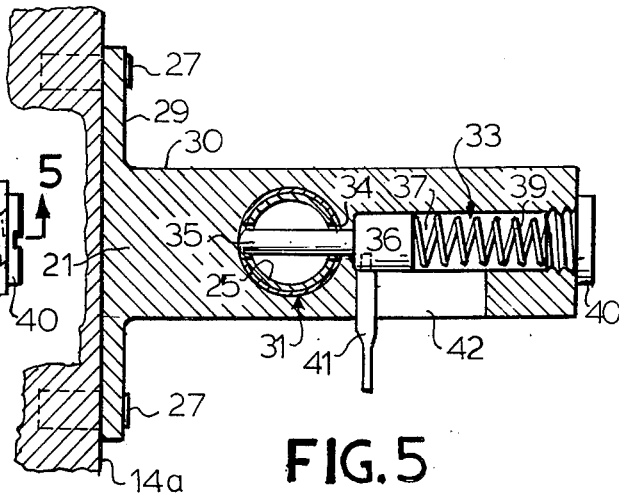
FIG. 5

FIG. 6
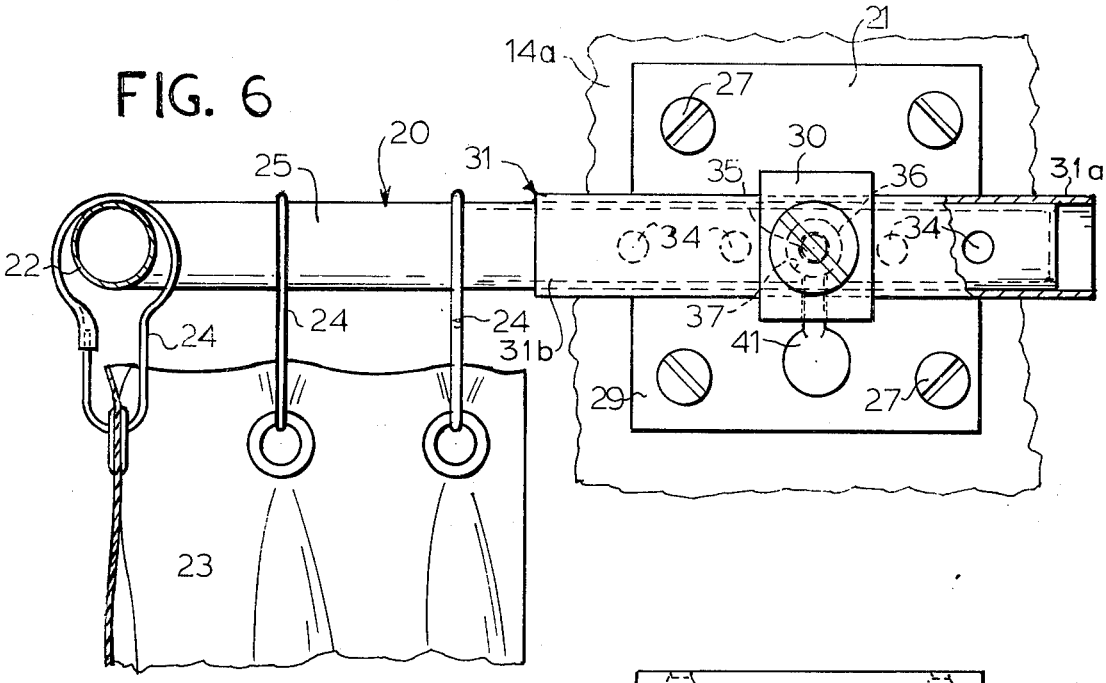
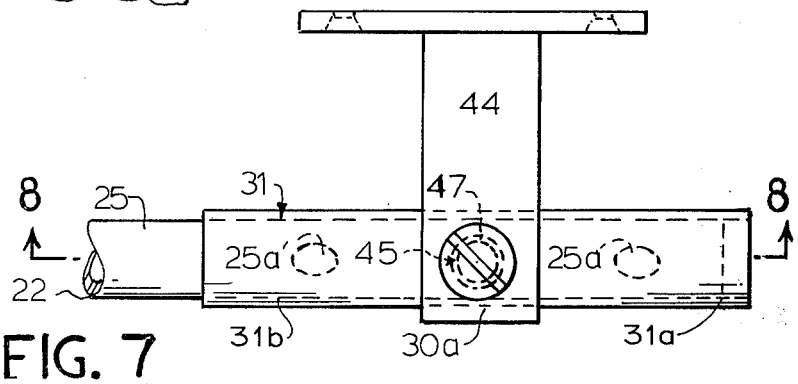
FIG. 7
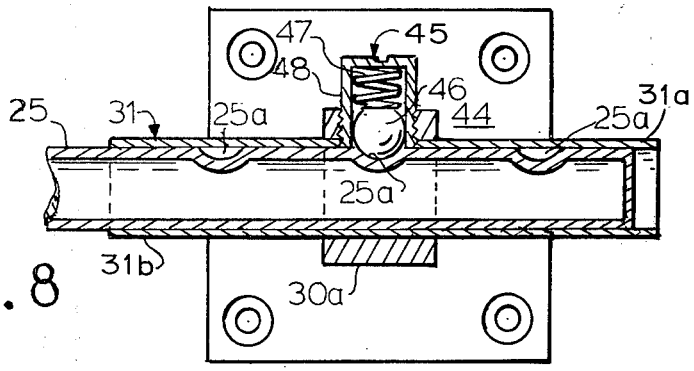
FIG. 8

HORIZONTALLY ADJUSTABLE CURTAIN RODS FOR BATHROOM STALLS

This invention relates to curtain supports for use with tub and shower compartments, and more especially to a cantilevered U-shaped curtain rod which is laterally adjustable to various positions relative to the compartment while maintaining the same corresponding vertical positions.

Heretofore, various devices have been provided for supporting a straight curtain rod and the suspended curtain for movement back and forth through the compartment doorway. U.S. Pat. No. 2,573,985 discloses a curtain rod assembly typical of such prior art devices wherein the rod is eccentrically mounted for bodily rotation about bracket pivots located respectively on the doorway jambs and above the front wall of the tub, the latter also serving as a sill or tread for the doorway. Where straight rods are mounted as described above, incomplete coverage of the doorway results due to the difficulty of forming leak-proof connections between the lateral edges of the curtain and the opposed doorway jambs, thus allowing escape of water from the compartment during use.

It is therefore an object of this invention to obviate the aforementioned deficiency by providing a telescopically cantilevered U-shaped rod adapted to suspend a curtain from its three segments so that the intermediate segment will cover the intermediate portion of the doorway while the parallel leg segments extend rearwardly of the compartment and suspend the opposite ends of the curtain alongside the doorway jambs to form substantially leak-proof connections.

It is another object of this invention to provide detent means for yieldingly securing the telescopically cantilevered U-shaped curtain rod is select positions whereby the suspended curtain may be positioned accordingly.

It is a further object of this invention to provide a curtain rod assembly of the type described which is simple in construction, relatively inexpensive to manufacture and install, and easy to manipulate by the user. Such further object is realized by the provision of a pair of triple-arm cantilevered wall brackets which, in turn, telescopically support the U-shaped curtain rod in cantilevered position and for movement in a rectilinear path back and forth through the doorway in a manner described in detail below.

Some of the objects of invention having been stated, other objects will appear as the description proceeds when taken in connection with the accompanying drawings, in which, FIG. 1 is a front view of a bathroom stall, showing a curtain rod assembly according to the invention mounted therein;

FIG. 2 is a vertical sectional view taken along line 2—2 in FIG. 1;

FIG. 3 is a sectional plan view of FIG. 1;

FIG. 4 is an enlarged sectionsl plan view of the curtain rod and supporting sleeved bracket illustrated on a smaller scale in FIGS. 1–3;

FIG. 5 is a vertical sectional view taken along the line 5—5 in FIG. 4;

FIG. 6 is an enlarged sectional view of the curtain rod and supporting rod bracket shown on a smaller scale in FIG. 2;

FIG. 7 is a plan view of a modified form of the invention, and

FIG. 8 is a sectional view taken along the line 8—8 in FIG. 7.

Referring more particularly to the drawings, the numeral 10 denotes a bathroom stall comprising a tub or catch basin 11, a back wall 12, and opposed side walls 14 and 15. The tub or basin 11 has has a front wall 16 which also serves as a tread or sill for the doorway 19 thereabove, said doorway having jambs **14*a* and 15*a* flush with the side walls 14 and 15 respectively. The stall 10 is provided with conventional fixtures such as shower head 17 and valve assembly 18. Where the stall is used only for shower baths, the front wall 19** is of lesser height but sufficient to retain water in the catchbasin.

A horizontally adjustable rod assembly 20 is supported between the opposed doorway jambs **14*a* and 15*a*, said assembly comprising brackets 21, 21, U-shaped curtain rod 22, and curtain 23. The curtain is suspended from the rod by suitable means such as rings or hooks 24. The curtain rod 22 consists of a pair of parallel leg segments 25, 25 for suspending the end portions of the curtain in spaced relation to side walls 14 and 15 and an intermediate connecting base or trough segment 26 lying in the plane of the leg segments for suspending the intermediate curtain portion over doorway 19**.

Brackets 21, 21 are secured to jambs **14*a*, 15*a* respectively by suitable means such as expansion screws 27 so that the rod segments 25, 25 and 26 lie in a horizontal plane and in cantilevered position. More specifically, each bracket 21 is formed from a wall plate 29 (FIGS. 4–6) having integral therewith cantilevered hub 30, said hub being provided with a fixed horizontal sleeve 31 in which a leg segment 25 is telescopically supported. Sleeves 31, 31 serve as elongated bearings for the legs 25, 25 of U-shaped rod 22 and must be of sufficient length to guide the rod to successive parallel positions when the latter is adjusted to suit conditions of use of the curtain 23 suspended therefrom. Moreover, the sleeves prevent binding during adjustment of position of U-shaped rod 22 thus facilitating adjustment operations. When the shower head 17 or the tub 10 is used by an occupant, the lower end of curtain 23 is suspended against the inside surface of front wall 16 as shown in FIGS. 1–3; when the bath is finished, the curtain is shifted inwardly of the stall and away from wall 16 to dry; and then the dried curtain is shifted outwardly of the stall and suspended in face-to-face position with the outside surface of wall 16 where it is fully exposed to view while covering the doorway 19**.

As best seen in FIG. 6, the sleeve 31 is fixedly mounted substantially at its mid-point upon the free end portion of cantilevered hub or arm 30 thereby causing the opposite sleeve end portions or arms **31*a* and 31*b* to be cantilevered from said point rearwardly and forwardly of the stall, respectively. When the U-shaped rod assembly 20 is in cantilevered position and with the leg 25 thereof fully inserted into sleeve 31 as shown, the rearwardly cantilevered arm 31*a* will react downwardly and the forwardly cantilevered arm 31*b* will react upwardly to the weight of the cantilevered assembly 20. Thus, the two short sleeve arms or portions will jointly resist the counterclockwise rotation of the assembly about hub 30 (FIG. 6) to provide balanced resisting reactions rearwardly and forwardly of hub 30** which, in turn, stabilizes the bracket.

The U-shaped curtain rod 22 may be releasably held in the above-described positions by means of a latching or locking mechanism broadly designated by the reference numeral 33. By observing FIGS. 4 and 5 the detailed construction of the mechanism will be better understood. The leg segment 25 is provided with spaced openings 34 corresponding to the positions selected for the suspended curtain to assume, each of said openings being coincidable with the inner end 35 of plunger 36 which, in turn is slidably mounted in bore 37 disposed longitudinally within hub 30. A spring 39 is confined in bore 37 by suitable means such as stud screw 40, thereby yieldingly pressing plunger end 35 into a selected opening 34 in leg 25. In order to manually release the plunger end from its selected opening 34, a lug 41 is provided, said lug projecting downwardly from plunger 36 through slot 42 and to a position where it can be manually engaged.

FIGS. 7 and 8 show a modified form of bracket assembly 44 wherein the U-shaped rod 22 is held in selected positions by a spring-pressed detent means 45, said means being releasable from a selected position in response to the application of a predetermined horizontal pressure axially of leg segment 25 and associated sleeve 31. At least one leg segment 25 of rod 22 is provided with spaced recesses or indentations **25*a* adapted to be selectively and yieldingly engaged by ball 46 under the pressure of spring 47 mounted in pipe segment 48, which segment is mounted upon hub 30*a***.

We claim:

1. In a bath compartment (10) having a back wall (12), a pair of side walls (14, 15), a front doorway (19) between said side walls, a U-shaped rod assembly (20) including a pair of parallel leg segments (25, 25) and an intermediate trough segment (26) lying substantially in a common plane, and means for suspending a curtain (23) from said leg and trough segments, in combination with means for cantilevering said assembly for back and forth bodily movement in a retilinear path through said doorway comprising a pair of juxtaposed hubs (30, 30) cantilevered respectively from said side walls and inwardly of said compartment;

a pair of parallel sleeves (31, 31) for telescopically receiving said leg segments (25, 25) respectively, and means for fixedly mounting each of said sleeves (31, 31) transversely upon the free end portion of its associated cantilevered hub (30) and in spaced relation to its proximate side wall, the opposite end portions **(31*a*, 31*b*) of said sleeve being cantilevered from its mount rearwardly and forwardly of said compartment respectively, whereby said rearwardly cantilevered sleeve portions (31*a*, 31*a*) will react downwardly to the weight of the cantilevered assembly (20) and said forwardly cantilevered sleeve portions (31*b*, 31*b*)** will react upwardly.

2. The apparatus defined in claim 1 and further comprising means (33) on at least one of said hubs (30, 30) for selectively securing said assembly (20) in a plurality of positions along its path of movement.

3. The apparatus defined in claim 2 wherein said last-named means comprises a spring detent (45) releasable from said secured positions in response to a predetermined pressure upon said cantilevered assembly.

* * * * *